US005515966A

United States Patent [19]

Hodge et al.

[11] Patent Number: 5,515,966

[45] Date of Patent: May 14, 1996

[54] CARTON WITH IMPROVED CLOSURE AND DISPLAY MEANS

[76] Inventors: Donald C. Hodge; Melanie B. Hodge, both of 711 East Ave.; Kathryn A. Powell, 411 Bald Mountain Rd., all of Ketchum, Id. 83340

[21] Appl. No.: 230,072

[22] Filed: Apr. 20, 1994

[51] Int. Cl.[6] ..... B65D 85/18

[52] U.S. Cl. ..... 206/292; 206/299; 206/481; 206/524.9

[58] Field of Search ..... 206/45.14, 292, 206/297, 299, 495, 477, 481, 483, 491

[56] References Cited

U.S. PATENT DOCUMENTS

| | | | |
|---|---|---|---|
| 3,337,734 | 8/1967 | Meyers | 206/45.14 |
| 3,517,801 | 6/1970 | Cote | 206/45.14 |
| 3,592,337 | 7/1971 | Phillips | 206/491 |
| 4,069,915 | 1/1978 | Schurman | 206/477 |
| 4,126,220 | 11/1978 | Roccaforte | 206/45.14 |
| 4,207,978 | 6/1980 | Patterson et al. | 206/491 |
| 4,257,522 | 3/1981 | Thorneburg | 206/299 |
| 4,508,225 | 4/1985 | Ferrari | 206/477 |
| 5,029,702 | 7/1991 | Tong | 206/315.1 |
| 5,141,105 | 8/1992 | Maye | 206/44 |
| 5,150,813 | 9/1992 | Harris et al. | 220/480 |

*Primary Examiner*—Paul T. Sewell
*Assistant Examiner*—Tara L. Laster
*Attorney, Agent, or Firm*—Haverstock, Garrett & Roberts

[57] ABSTRACT

A carton for holding a variety of products characterized by improved closure construction and display characterized by a back panel with a pair of side panels attached thereto, including a bottom portion for holding a product in place and further characterized by a strap located above the lower front panel adapted to traverse the contained product and latched on the back of the carton to hold the product in place for display and sale.

13 Claims, 2 Drawing Sheets

CARTON WITH IMPROVED CLOSURE AND DISPLAY MEANS

The present invention relates generally to a carton for holding a variety of products, particularly products such as insoles for footwear, characterized by a folding carton construction having improved closure means and improved product display and accessibility.

BACKGROUND OF THE INVENTION

Many different types of cartons for packaging products have been designed and manufactured for use in a multitude of applications and many such constructions are in commercial use today. Such known assemblies teach a wide variety of constructions for displaying and removing contents from a carton. Many of the known constructions for displaying and marketing products such as insoles for footwear, tools, and other products adapted to being displayed in a container are today most usually confined in a container or package by means off a plastic shrink-wrap system wherein plastic sheets made from poly vinyl chloride resins, polyoelfins such as polyethylene, ABS copolymers and other polymeric materials capable of being heat shrunk are used to shrink-wrap a product in one of the conventional systems.

None of the known package constructions provides for a carton with improved closure and display means with ready access to the product in the package.

SUMMARY OF THE INVENTION

The present carton construction overcomes many of the disadvantages and shortcomings of known constructions and teaches a recloseable type carton having means for quickly enclosing the product being displayed and ready availability of the product being displayed for review by a potential purchaser. The invention is characterized by a hinged wrap-around closure construction with attachment means to mate on the backside with mating attachment means to hold the product in the package for display, while at the same time providing maximum exposure of the packaged product.

The carton of this invention replaces closeable boxes, plastic packages and plastic snug-wrapped systems, because this invention does not need, and would not include, any type of plastic overlay because it is anticipated that the displayed product may be felt, removed for evaluation and placed back into the package without damage to the package. As a specific example, this invention provides for the display of products such as insoles for footwear such as ski boots in a package which displays the insoles, allows a customer to feel the insoles and makes them easily accessible for being removed and even checked for fit in a particular ski boot before completing the purchase. When such products have been previously packaged and sold in packages of plastic overwraps, the throw away rate has caused the business to be economically disadvantaged because once a pair of insoles was removed from the package the package could not be redisplayed because the plastic overwrap had been destroyed. The same problem occurs with plastic bags stapled together with header cards and also boxes with folding tabs that become damaged. Although this invention is uniquely adapted to marketing insoles for footwear, athletic wraps, and knee and ankle supports, other products such as tools, toys, dolls, slippers, etc. can be marketed in the carton of this invention.

Another advantage for the present invention is the fact that the present carton can be made from a unitary blank of foldable sheet material having fold lines, die cuts, glue laps and a pre-cut wrap-around strap which can be shipped flat to save space and shipping costs. Alternatively, the carton can have an outer glue line adhesively joined to a mating over-lap on the opposite side, and the cartons shipped flat in preassembled condition so that the cartons can be easily assembled and the product inserted at the site for immediate display and sale. With this system, the product may be acquired from one source and the carton blanks from a totally different source for easy assembly at the point of distribution of the product.

The present carton is preferably made from a paper board type material, although other types of sheet material such as plastic impregnated fiber sheet material, starch impregnated plastic, and like materials may be utilized in the practice of the present invention so long as such materials can be cut, scored and folded, as will be hereinafter explained.

DETAILED DESCRIPTION OF THE DRAWINGS

Figure 1:
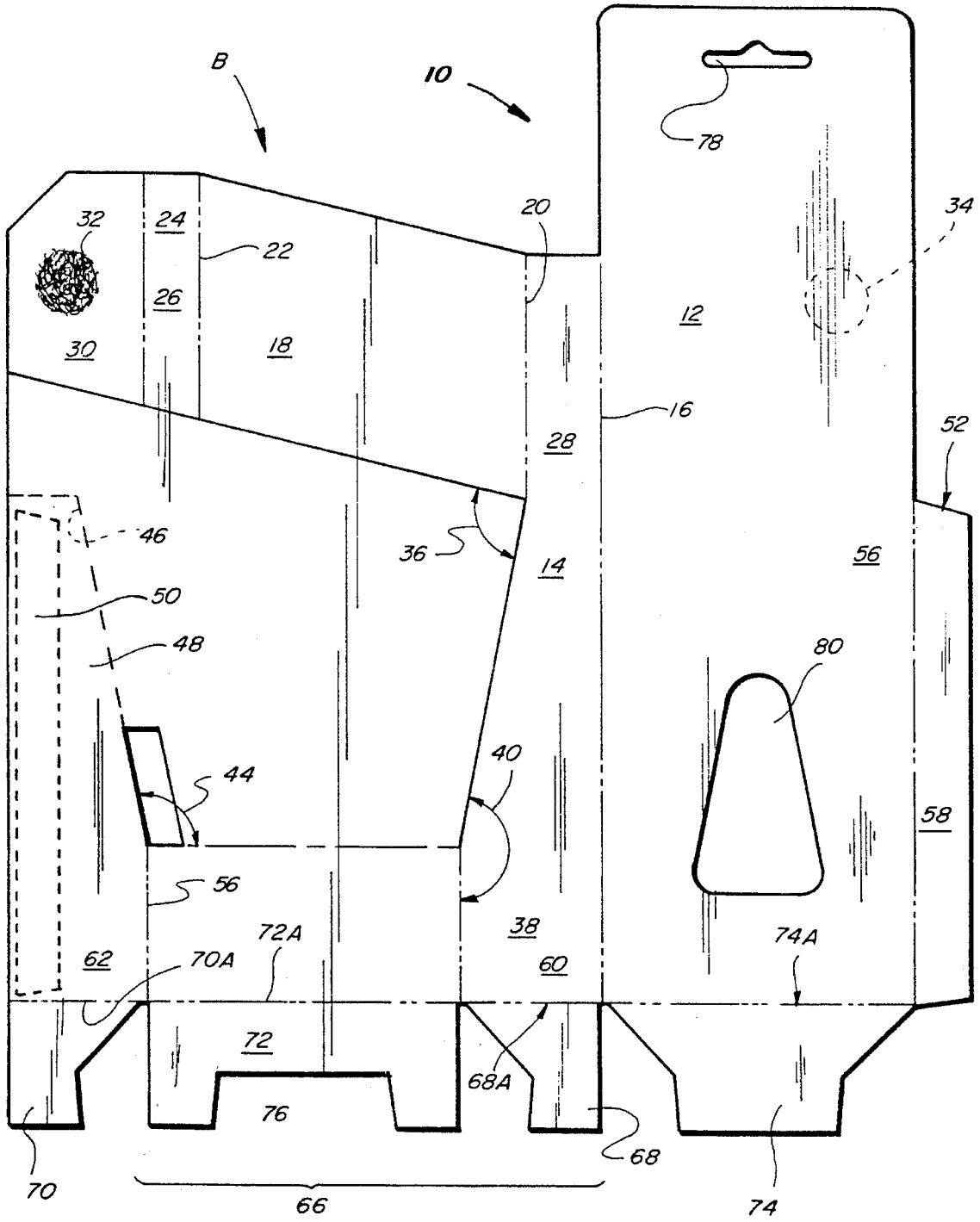
FIG. 1 is a plan view of the front of a blank of foldable sheet material from which the carton of this invention may be formed.
Figure 2:
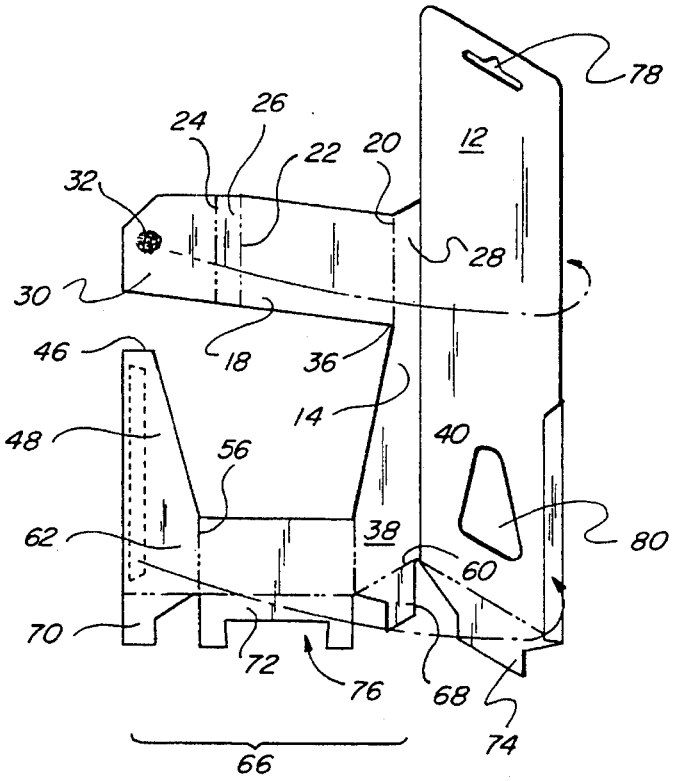
FIG. 2 is a perspective view of the carton of this invention partially assembled.

In the drawings, like numbers and like letters refer to like parts. The letter B in FIG. 1 identifies a unitary blank of foldable sheet material from which the carton of this invention may be formed and assembled. Blank B may be cut, die scored, and fold lines indented in the conventional practices for preparing cannons.

Cannon 10 includes back panel 12 which defines the peripheral size of the package when finally assembled. Left side panel 14 defines the parameters of the left side of the box when assembled and is attached to back panel 12 at left fold line 16. Left side panel 14 at its upper extremity in rectangular configuration forms part of strap 18 at strap fold line 20 when the carton 10 is assembled. Inner strap fold line 22 and strap fold line 20 define the portion of the strap 18 which will traverse the front of the carton 10 and retain the contents when fully assembled. Outer strap fold line 24 along with inner strap fold line 22 define the portion of the strap 18 which will provide the right panel 26 when the carton is fully assembled, and will be the same width as strap section 28. Outer extremity 30 of strap 18 will contain attachment means 32 adapted to mate with rear attachment means 34 when the carton is assembled.

Left side panel 14 at angle 36 of left side panel 14 defines a widening of the lower portion of left side panel 14 to form a wider lower portion 38 of left side panel 14 as defined by lower angle 40. Removable panel 42 is die cut around the periphery in order to provide product display space when the carton is assembled with a product inside. Removable panel 42 is die cut at removable panel angle 44 upward to angle 46 outward to the outer edge of blank B to form right side panel 48 when the carton 10 is assembled. Angle 36 will preferably be at about 100° from vertical to provide a strap 18 which traverses the carton 10 at an upward angle of about 10° from horizontal. A slight upward angle for strap 18 is preferred to provide better containment of the packaged product, and for aesthetic purposes. Angle 36 thus may range from about 90° to about 120° to provide a strap 18 which traverses the carton 10 at right angle from the vertical to an upward angle of about 10° to 20° from the horizontal. Right side panel 48 will be identical in size to the lower portion of left side panel 14 in order to form a carton 10 of uniform construction when assembled. Right side panel 48 will include left glue line 50 which is adapted to overlap and mate with right glue line 52 when right side panel 48 is creased at right fold line 56 and adhesively joined in mating relationship with right glue line 52 when the carton is assembled.

Figure 3:
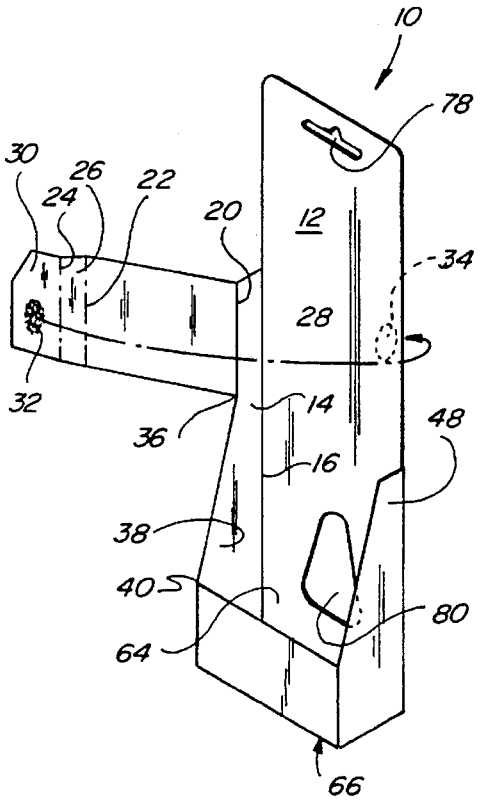
FIG. 3 is a perspective view of the carton of this invention in assembled form; and, FIG. 4 is a perspective of the present invention with a pair of insoles for ski boots displayed and retained in the carton to form a package.
Figure 4:
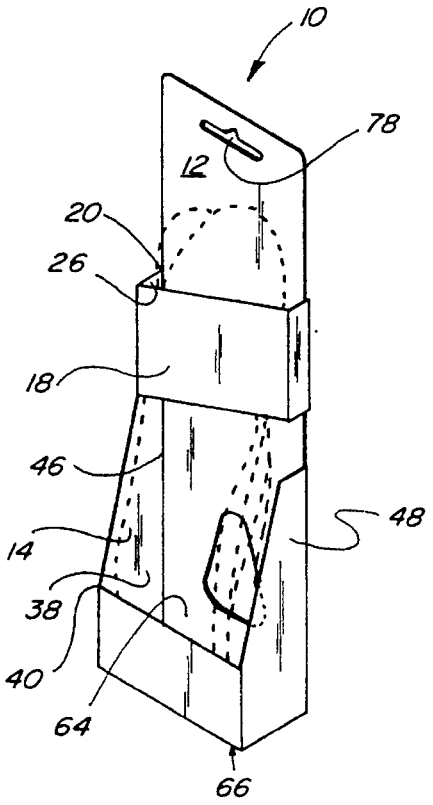

Lower left side panel cross dimension 60 will be identical to lower right side panel cross dimension 62 so that the lower pocket container 64 will be uniform in order to provide a pocket container 64 with uniform dimensions. Pocket container 64 is best shown in FIGS. 3 and 4.

Bottom 66 of carton 10 is created by folding inward left tab 68 at fold line 68A and right tab 70 at fold line 70A and, thereafter, folding inward center tab 72 at fold line 72A and, thereafter, folding wing tab 74 at fold line 74A into center tab opening 76 to complete the assembly of carton 10.

Upper opening 78 in back panel 12 provides an opening for hanging carton 10 for display purposes. Lower opening 80 in back panel 12 is primarily for decorative purposes but may also be used to display the back of the product contained in canon 10. For example, size and instructions may often be viewed through lower opening 80.

Carton 10 may be preassembled by folding left side assembly 13 in the indicated places and gluing left glue line 50 to right glue line 52. In this condition, cartons can be shipped flat for final assembly where the product will be distributed. The final assembly can be completed quickly by assembling right tab 68, left tab 70, center tab 72 and wing tab 74, thereafter inserting the product being marketed and wrapping strap 18 about the inserted product into final assembly by attaching attachment means 32 to rear attachment means 34. Removable panel 42 is removed immediately prior to the final assembly. Removable panel 42 may be left in the blank B with final assembly to provide stability during shipment.

The present carton 10 is preferably made from a paper board type material, although other types of sheet material such as plastic impregnated fiber sheet material, starch impregnated plastic materials and like materials may likewise be utilized in the practice of the present invention so long as such materials may be cut, scored and folded as discussed herein.

The dimensions of the carton 10 of this invention will vary according to the product being marketed and the size of such product. For example, when insoles for ski boots are being marketed in carton 10 of this invention, back panel 12 will probably range from about 12 to 14 inches in length and about 4 to 5 inches in width. Strap 18 will be broad enough to assure stability of the packaged product, and will generally be about two to three inches wide. Strap 18 is angled slightly upward as described herein to provide additional esthetic qualities and to better display the packaged product. Side panels 14 and 48 in carton 10 used to display and market insoles for ski boots will generally be about 1 to 1 ½ inches wide at their upper portions and about 1 ½ to 2 inches wide at their lower portions.

Mating attachment means 32 and rear attachment means 34 are preferably made from small sections of Velcro separable fasteners. Velcro is a registered trademark of Velcro U.S.A. Inc., Manchester, N.H., for separable fasteners—namely, hook and loop type fasteners and components thereof. Although Velcro separable fasteners are preferred in the practice of this invention, other separable fasteners and other attachment means such as snaps, zippers and other conventional attachment means are considered to be within the scope of this invention. In the preferred practice of this invention, attachment means 32 and rear attachment means 34 are circular Velcro patches about ¾ inch in diameter which are glued respectively to the front of outer extremity 30 and the back of back panel 12 in mating relationship. Obviously, the size and configuration of the Velcro attachment means may vary depending on the size and utility of the carton 10.

Thus, there has been shown and described a novel carton with improved closure and display means construction which carton fulfills all of the object and advantages sought therefor. Many changes, modifications, variations and other uses and applications of the present carton with improved closure and display means construction will, however, become apparent to those skilled in the art after considering this specification and the accompanying drawings. All such changes, modifications, variations and other uses and applications which do not depart from the spirit and scope of the invention are deemed to be covered by the invention, which is limited only by the claims which follow.

We claim:

1. A carton comprising:

a back panel having a front and a back surface, and a first and second longitudinal edges, first panel attached to said first longitudinal edge, second panel attached to said second longitudinal edge, said first and second panels being traversed by a lower front panel and a bottom to form a lower container for holding a product in place, said first panel having a strap integrally attached thereto located above said lower front panel traversing the front of said carton and being wrapped around said back panel and attached to said back surface of said back panel, and means for repetitively coupling said strap to said back surface of said back panel.

2. The carton as described in claim 1 wherein the carton is constructed of paper board material.

3. The carton as described in claim 1 wherein said coupling means includes a hook and loop type fastener and separably attaches said strap to the back surface of said back panel.

4. The carton as described in claim 1 wherein said first and second panels are shorter than said back panel.

5. The carton as described in claim 4 wherein said second panel is shorter than first panel.

6. The carton as described in claim 5 wherein said first and second panels are of substantially similar geometrical configuration.

7. The carton as described in claim 1 wherein said first panel and said back panel includes a plurality of tabs at their lower extremity.

8. The carton as described in claim 1 wherein said first panel and said strap having a hinge line therebetween about which said strap pivots into closed and open positions.

9. The carton as described in claim 8 wherein said strap is disposed at an angle about 90° to about 120° from said hinge line.

10. A blank of foldable sheet material comprising:

a back panel having a front and a back surface and having attached thereto a first panel adapted to form a side of a carton, and a second panel adapted to form the opposite side of said carton, a strap integrally attached to said first panel traversing the front surface of said carton and being attached to the back of said back panel to form an upper containment means, said strap and said first panel forming a fold line therebetween, wherein said strap is located at an angle from the fold line of said first panel at an angle ranging from about 90° to about 120°, and a series of tabs at the lower extremity of said blank adapted to be folded to form a bottom of said carton.

11. The blank of foldable sheet material as described in claim 10 wherein the blank is constructed of paper board material.

12. The blank of foldable sheet material as described in claim 10 further comprising a coupling means for repetitively coupling said strap to the back surface of said back panel.

13. The carton as described in claim 10 wherein said strap ranges from about 2 to about 3" in width.

* * * * *

UNITED STATES PATENT AND TRADEMARK OFFICE

CERTIFICATE OF CORRECTION

PATENT NO. : 5,515,966
DATED : May 14, 1996
INVENTOR(S) : Hodge et al

It is certified that error appears in the above-indentified patent and that said Letters Patent is hereby corrected as shown below:

Column 2, line 42, "cannons" should be --cartons--.
Column 2, line 43, "Cannon" should be --Carton--.
Column 3, line 31, "cannon" should be --carton--.

Signed and Sealed this

Twentieth Day of August, 1996

*Attest:*

Bruce Lehman

BRUCE LEHMAN

*Attesting Officer*

*Commissioner of Patents and Trademarks*